US009233407B2

(12) United States Patent
Windingstad et al.

(10) Patent No.: US 9,233,407 B2
(45) Date of Patent: Jan. 12, 2016

(54) MULTIPUNCH WITH AXIAL RETAINER FOR SECURING MULTIPLE DIES OR STRIPPERS

(71) Applicants: Ronald C. Windingstad, White Bear Township, MN (US); Bruce M. Thielges, Fridley, MN (US)

(72) Inventors: Ronald C. Windingstad, White Bear Township, MN (US); Bruce M. Thielges, Fridley, MN (US)

(73) Assignee: Mate Precision Tooling, Inc., Anoka, MN (US)

( * ) Notice: Subject to any disclaimer, the term of this patent is extended or adjusted under 35 U.S.C. 154(b) by 289 days.

(21) Appl. No.: 13/943,050

(22) Filed: Jul. 16, 2013

(65) Prior Publication Data

US 2015/0020663 A1 Jan. 22, 2015

(51) Int. Cl.

| | |
|---|---|
| ***B30B 15/02*** | (2006.01) |
| ***B30B 15/08*** | (2006.01) |
| ***B21D 28/12*** | (2006.01) |
| ***B21D 45/00*** | (2006.01) |

(52) U.S. Cl.

CPC ..... *B21D 28/125* (2013.01); *B21D 45/003* (2013.01); *Y10T 83/215* (2015.04); *Y10T 83/8732* (2015.04); *Y10T 83/9476* (2015.04)

(58) Field of Classification Search

CPC ..... B21D 28/125; B21D 28/14; B21D 28/36; B21D 45/003; Y10T 83/215; Y10T 83/9476; Y10T 83/8732

See application file for complete search history.

(56) References Cited

U.S. PATENT DOCUMENTS

| | | | |
|---|---|---|---|
| 2,346,925 | A | 4/1944 | Lewis |
| 4,092,888 | A | 6/1978 | Wilson |
| 5,460,027 | A | 10/1995 | Takahashi |
| 5,884,546 | A | 3/1999 | Johnson |
| 5,885,626 | A | 3/1999 | Chatterjee et al. |
| 6,785,959 | B2 | 9/2004 | Sawdon et al. |
| 6,895,797 | B2 | 5/2005 | Lowry et al. |
| 7,168,364 | B2 | 1/2007 | Schneider |
| 7,726,554 | B2 | 6/2010 | Thielges et al. |
| 7,874,194 | B2 | 1/2011 | Shimota et al. |

(Continued)

FOREIGN PATENT DOCUMENTS

| | | | |
|---|---|---|---|
| EP | 0 396 817 | A2 | 11/1990 |
| EP | 0556877 | A2 | 8/1993 |

(Continued)

OTHER PUBLICATIONS

Korean Intellectual Property Office, International Search Report and the Written Opinion of the International Search Authority, or the Declaration with Notice, for corresponding International Application No. PCT/US2014/046543, dated Nov. 6, 2014, 10 pages.

(Continued)

*Primary Examiner* — Stephen Choi

(74) *Attorney, Agent, or Firm* — James V. Harmon; Nikolai & Mersereau, P.A.

(57) ABSTRACT

A multiple punch and die assembly body member has dies or strippers that are held within multiple pockets in a multipunch body member by means of a centrally positioned retaining member formed from a rigid or flexible material located in a central recess at the middle of a ring of the surrounding dies or strippers. The retaining member is preferably held in place by a push plate that can be secured to the multipunch body member by a tightening element, e.g., a screw fastener for pressing the peripheral surface of the retainer member into engagement with the dies or strippers to hold them in their respective pockets in the multipunch body member.

20 Claims, 6 Drawing Sheets

(56) References Cited

U.S. PATENT DOCUMENTS

| | | | | |
|---|---|---|---|---|
| 7,913,618 | B2 | 3/2011 | Ferry et al. | |
| 7,954,404 | B2 | 6/2011 | Thielges et al. | |
| 8,152,052 | B2 | 4/2012 | Thielges et al. | |
| 8,376,215 | B2 | 2/2013 | Thielges et al. | |
| 8,413,561 | B2 | 4/2013 | Thielges et al. | |
| 2001/0039867 | A1* | 11/2001 | Ostini | 83/552 |
| 2002/0162440 | A1 | 11/2002 | Ostini | |
| 2009/0078098 | A1* | 3/2009 | Lee et al. | 83/140 |
| 2010/0212469 | A1 | 8/2010 | Thielges et al. | |
| 2010/0229701 | A1* | 9/2010 | Thielges et al. | 83/13 |
| 2011/0107888 | A1* | 5/2011 | Thielges et al. | 83/139 |
| 2011/0296969 | A1 | 12/2011 | Lenzotti | |
| 2012/0199642 | A1 | 8/2012 | Thielges et al. | |
| 2013/0047808 | A1 | 2/2013 | Windingstad | |

FOREIGN PATENT DOCUMENTS

| | | | |
|---|---|---|---|
| EP | 0 727 263 | A1 | 8/1996 |
| EP | 0 938 938 | A2 | 2/1999 |
| EP | 1 089 837 | B1 | 6/1999 |
| EP | 2 079 565 | A1 | 7/2009 |
| EP | 2 392 420 | A1 | 7/2011 |
| EP | 2 498 929 | A1 | 9/2012 |
| JP | 2142626 | A * | 5/1990 |
| WO | WO9967039 | A1 | 12/1999 |
| WO | WO2005018849 | A1 | 3/2005 |
| WO | WO2008048377 | A1 | 4/2008 |
| WO | WO2011059516 | A1 | 5/2011 |

OTHER PUBLICATIONS

Tooling Catalog Ultra MT Nova With Euro Prices 2007 Finn-Power, p. 22, published 2007.

* cited by examiner

MULTIPUNCH WITH AXIAL RETAINER FOR SECURING MULTIPLE DIES OR STRIPPERS

BACKGROUND OF THE INVENTION

I. Field of the Invention

The present invention relates to punch and die equipment, and more particularly to a multiple punch and die assembly that is adapted to be installed in a punch press.

II. Description of the Prior Art

A common multipunch often includes as many as ten or more separate punches, each with a corresponding aligned die and often with a stripper located proximate the bottom end of the punch for stripping the work from the punch when the punch is withdrawn. Punches, dies and strippers must be removed at regular intervals for sharpening or replacement. Up to the present this has been a time consuming operation because each time the dies or strippers are removed for cleaning, sharpening, adjustment or replacement, several separate setscrews or fasteners must be individually removed to withdraw the dies or strippers from the punch assembly. See, for example, in Patent EU 396817, FIG. 8. Performing this operation increases the downtime of the punch press. In addition, the multiple fasteners that are required add to the manufacturing cost of the assembly. The applicant of the present application has marketed an axial clamp consisting of eight separate metal shoes that are forced outwardly from the center against the dies to hold them in place, but this product is too expensive and is not suitable for certain applications. Moreover, the retention force cannot be varied to suit the conditions of use and is not uniformly applied over the surface of each die.

OBJECTS

It is therefore one object of the invention to find a way to simplify and streamline the mounting and demounting of dies and strippers from a punch or die assembly.

Another object is to reduce the time required for changing dies or strippers while at the same time reducing the number of parts required in a die or stripper clamping system.

Another object is to provide a means for applying pressure for effectively retaining the dies or strippers in place without scoring or otherwise damaging their surfaces.

Yet another object is to find a way to secure the dies or strippers of a multipunch assembly with a single fastener and a single retainer member to hold all of the dies or strippers in place.

Still another object is to hold dies or strippers in place on a multipunch assembly by applying pressure while including a provision for insuring that the parts will separate easily when pressure is removed.

Another object is to be able to remove the dies or strippers without removing the clamping mechanism itself.

A still further object is to be able to vary the retention force holding the dies or strippers in place to suit the circumstances of use.

The foregoing features, objects and advantages of the invention will become apparent to persons skilled in the art from the following detailed description of a preferred embodiment, especially when considered in conjunction with the accompanying drawings in which like numerals in the several views refer to corresponding parts.

SUMMARY OF THE INVENTION

Figure 1:
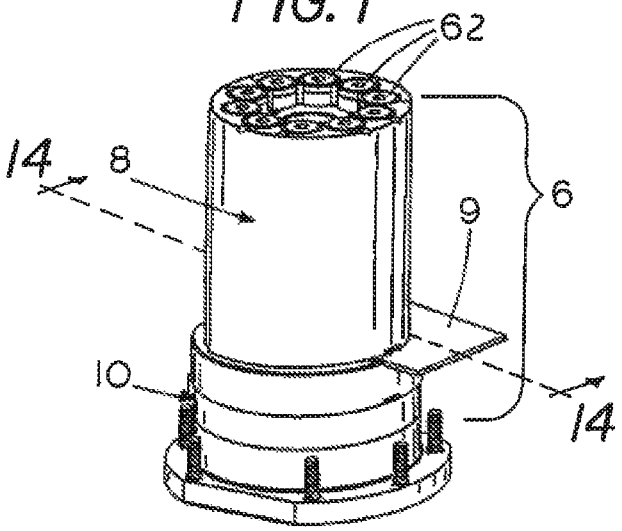
FIG. 1 is a diagrammatic perspective view of a punch assembly showing the upper and lower multipunch body members and a sheet metal workpiece.

In a multiple punch and die assembly (multipunch) now available commercially, the dies and strippers require a significant amount of time for removal and replacement. According to the present invention, the dies or strippers are held within multiple pockets in a multipunch body member by means of a retaining member formed from a rigid or flexible material located in a central recess that is concentrically positioned in the middle of a circle of surrounding dies or strippers. The retaining member is preferably held in place by a push plate that can be secured to the multipunch body member by a fastener or tightening element, e.g., a screw fastener for pressing the push plate and retainer into engagement with the dies or strippers to hold them in their respective pockets in the multipunch body member. By threading the push plate to the body member, the push plate itself can serve as the tightener.

This description is intended to be read in connection with the accompanying drawings, which are to be considered part of the entire written description of this invention. In the description, relative terms such as “lower”, “upper”, “horizontal”, “vertical”, “above”, “below”, “up”, “down”, “top” and “bottom” as well as derivatives thereof (e.g., “horizontally”, “downwardly”, “upwardly”, etc.) should be construed to refer to the orientation as then described or as shown in the drawings under discussion. These relative terms are for convenience of description and do not require that the apparatus be constructed or operated in a particular orientation. Terms such as “connected”, “connecting”, “damped”, “clamping”, “attached”, “attaching”, “join” and “joining” are used interchangeably and refer to one structure or surface being secured to another structure or surface or integrally fabricated in one piece, unless expressively described otherwise.

DETAILED DESCRIPTION OF THE PREFERRED EMBODIMENTS

Figure 2:
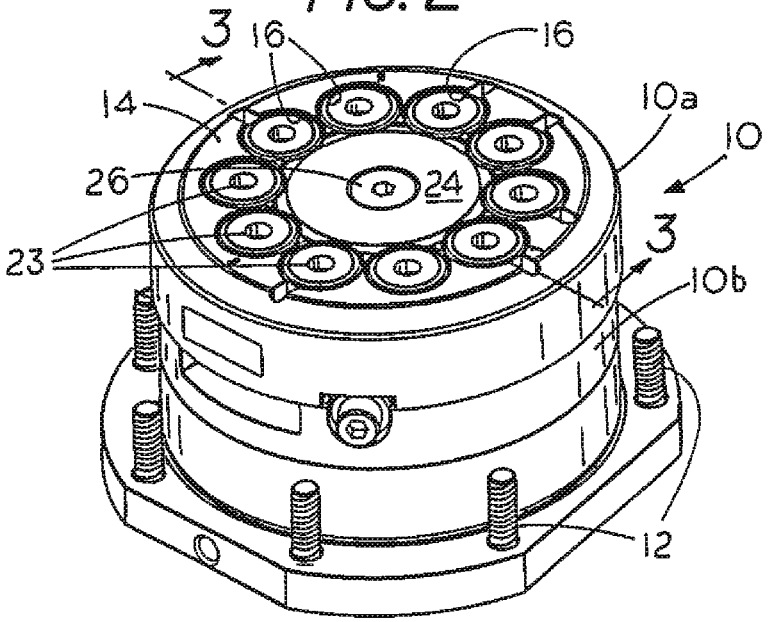
FIG. 2 is a perspective view of the lower multipunch body member with pockets on an upwardly facing surface holding ten dies.
Figure 3:
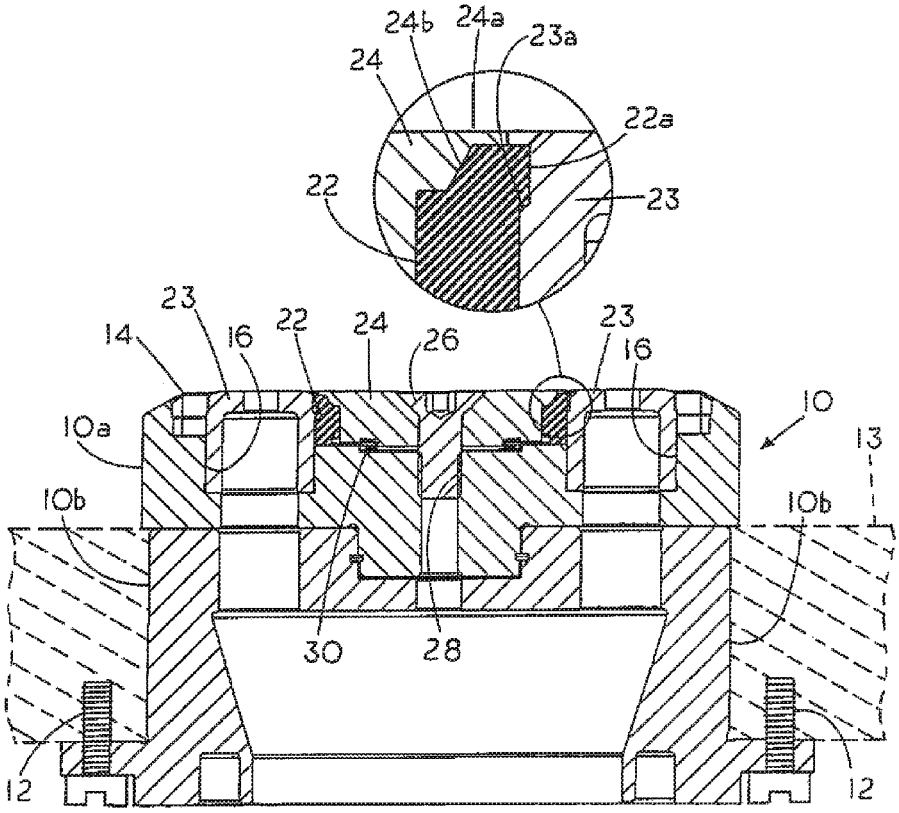
FIG. 3 is a vertical sectional view of FIG. 2 taken on line 3-3 of FIG. 2.

Refer now particularly to FIGS. 1-3 which show a lower multipunch body member 10 consisting of a top component 10*a* that functions as a die holder and a bottom component 10*b* secured to a supporting framework 13 as, for example, by means of cap screws 12 below an upper portion 8 of a multipunch and die assembly 6 of any suitable known construction such as those shown in U.S. Pat. No. 8,376,215, EP 2,498,929, 8,413,561, EP 2,079,565, WO 2008048377 and WO 2011059516.

Figure 4:
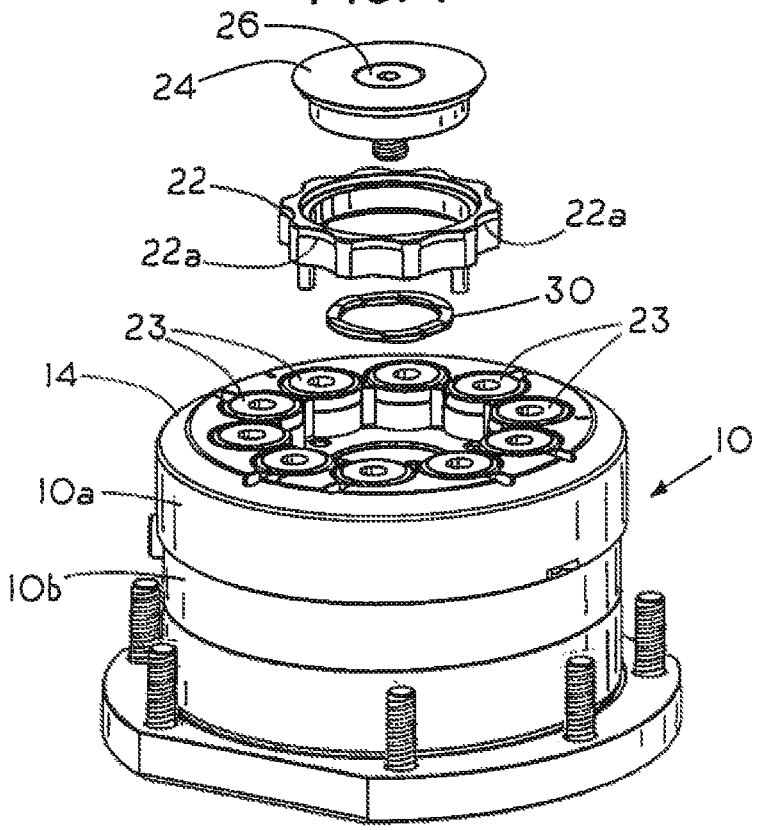
FIG. 4 is an exploded view of FIG. 1.

As shown in FIG. 2, the upper surface 14 of the punch assembly body member 10 is provided in this case with ten pockets 16, each of which comprises a partial cylinder with a centrally facing opening between spaced apart axial edges 18 (FIG. 5), each of which communicates with a central recess 20 that holds a circular ring-shaped retainer member 22 (FIGS. 3 and 4). The retainer is, in turn, held in place by a push plate 24 that is pressed into the recess 20 by means of a tightening element such as a screw fastener 26 that is threaded into a hole 28 in the body member 10*a*.

Figure 5:
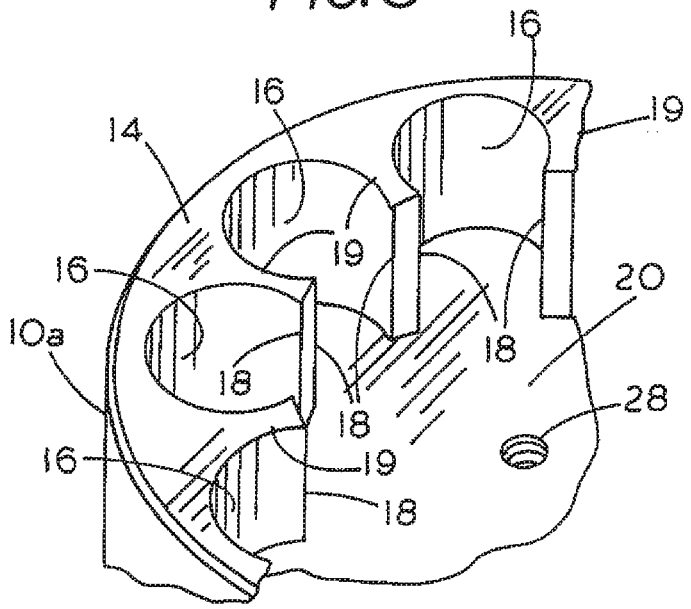
FIG. 5 is a partial perspective view of the body member of FIGS. 2-4 with the dies removed.
Figure 6:
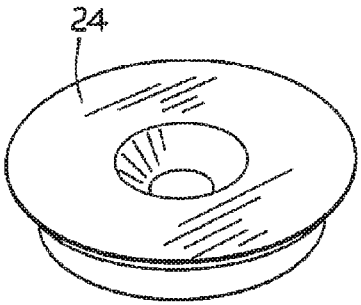
FIG. 6 is a perspective view of the push plate from above.
Figure 7:
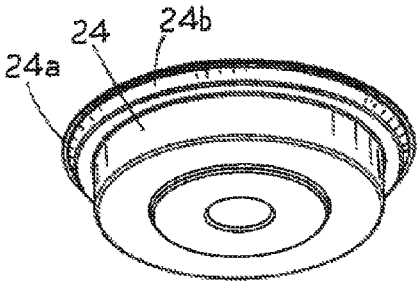
FIG. 7 is a perspective view of the push plate from below.

It will be noted in FIG. 5 that the dies have been removed so that the configuration of the pockets 16 and recess 20 in the retaining member can be clearly seen. It will be seen that the centrally facing openings between the edges 18 of partitions 19 between the pockets allow communication between the pockets 16 and the central recess 20 which holds the retainer 22. The pockets are arranged in a ring which can be of any shape; oval, square, circular, etc. and the retainer 22 which is shown by way of example as a circular ring can be correspondingly shaped as oval, square, triangular, circular, etc. Thus, the term ring herein is not intended to necessarily refer to a circle.

Figure 17:
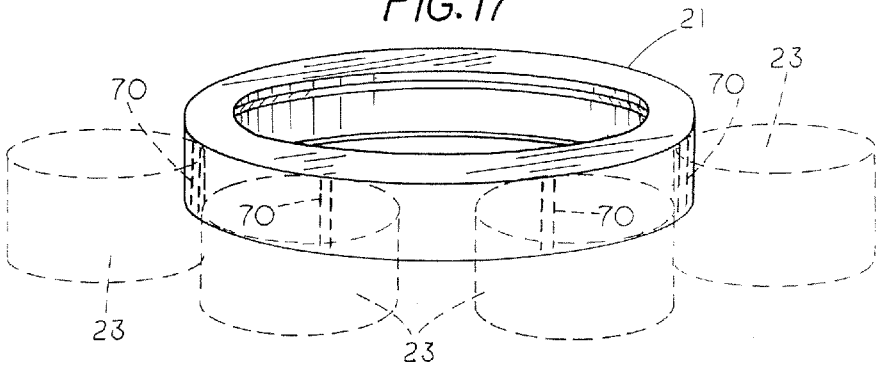
FIG. 17 is a perspective view of a die or stripper retainer without recesses in the peripheral sidewall to show how dies contact the sidewall along axial lines or strips.

FIG. 3 shows how a peripheral flange 24*a* on the push plate 24 pushes straight down on the die retainer 22. Below that is a tapered portion or camming element 24*b*, which is inclined to create an outward force on the die retainer 22 as the push plate 24 is forced downwardly by the screw fastener or other tightener. Thus when the fastener 26 is tightened, the downward pressure of the tightening disk or push plate 24 against the die retainer 22 will cause a peripheral surface of the retainer extending therearound to engage all of the dies and thereby hold the dies in place within the pockets 16. In the embodiment shown, each die 23 has a relief near its upper surface which defines an optional shoulder 23*a*. The retainer 22 is also provided with a circumferentially extending flange or lip 22*a* which engages the shoulder 23*a* of the die to hold it in place more effectively. Alternatively a lip can be spaced downwardly somewhat from the top edge of the retainer 22. If the lip 22*a* on the retainer member is located somewhat higher, e.g., 0.060 in. than a relief start point of each die, there will be sufficient allowance to enable the dies to be shimmed in an upward direction when the top of the die ground off to resharpen the die opening. The lip 22*a* of the retainer member 22 and corresponding grooves in the dies or strippers are optional since for some applications the tools can be held in place simply by mechanical engagement and/or friction between the retaining member and the die. Both the peripheral surface of the retainer member and the engaged surfaces of the dies or strippers would each have a cylindrical wall as shown in FIG. 17 that is straight axially with no ledge or groove therein.

The retainer member 22 can be formed from either rigid or flexible material such as rubber or plastic, e.g., polyurethane resin. It can be seen that when the screw fastener 26 is tightened by the tightening disk or push plate 24, the top surface of the retainer member 22 will be pressed downwardly when formed from a flexible material and will be deformed as it is compressed so that its peripheral surface expands laterally into tight engagement with the dies or strippers as the sidewall of the retainer moves outwardly perpendicular to the line of force. Friction between the retainer and the die then holds the die in place during each punching operation. It should also be noted that the applied pressure is radial and thus perpendicular to the line of force to which the die or stripper is subjected when a punching operation is being performed.

Following operation, all of the dies can be removed at once by loosening the center screw fastener 26 or other tightener to eliminate the applied pressure on the push plate, the retaining member and the dies. This makes it possible for the dies to be removed and replaced easily and quickly using a single fastener. By using a torque wrench, an operator can also vary the frictional engagement between the retainer 22 and the dies to suit the particular conditions of use. If desired, a compression spring such as a wave spring 30 can be placed between the retaining member and the multipunch body member to raise the push plate 24 and thus facilitate removal of the push plate 24. In a typical situation, the dies are usually pushed up from the bottom by hand to remove them.

Figure 8:
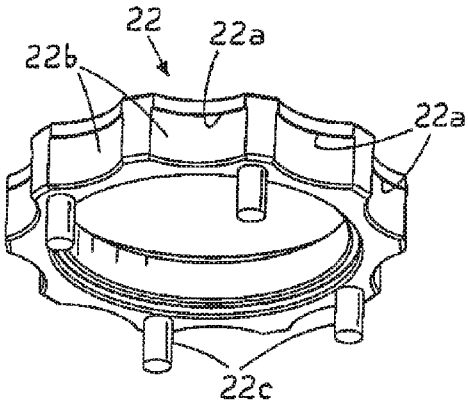
FIG. 8 is a perspective view of the die or stripper retainer as seen from below.
Figure 9:
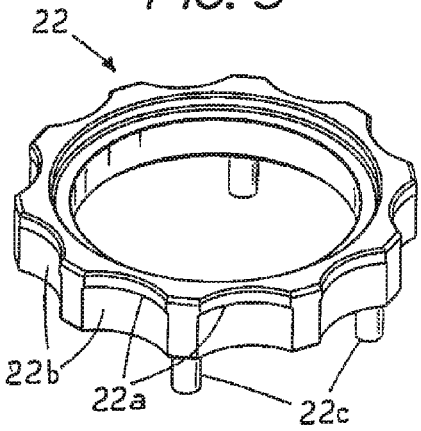
FIG. 9 is a perspective view of the die or stripper retainer as seen from above.
Figure 10:
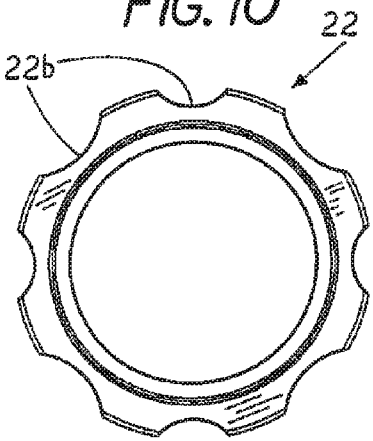
FIG. 10 is a plan view of the die or stripper retainer.
Figure 11:
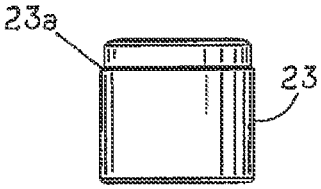
FIG. 11 is a side elevational view of a die.

FIGS. 8 and 9 show a preferred form in which the periphery of the retaining member 24 is provided with a plurality of outwardly opening partial recesses or scallops 22*b*, each shaped to custom fit around the inward aspect of one of the dies. The outwardly facing recesses 22*b* each define a tool engaging surface. This enables the unitary peripheral surface of the retainer to achieve optimum frictional contact with all of the dies. FIG. 3 shows how the outwardly extending lip 22*a* is provided to extend over, i.e., overlap, a shoulder 23*a* of each of the dies to hold each die more securely in place. The retaining member 22 also preferably provided with locating pins 22*c* which fit into corresponding holes in the punch body member to assure accurate alignment with the dies.

When the retaining member 22 is formed from a rigid material, such as steel, radial mechanical contact between the metal alone is usually not enough to hold each die securely in place. A rigid retaining member therefore employs the lips 22*a* on the retainer and a relief on each die or stripper to hold down the dies or strippers vertically.

Figure 12:
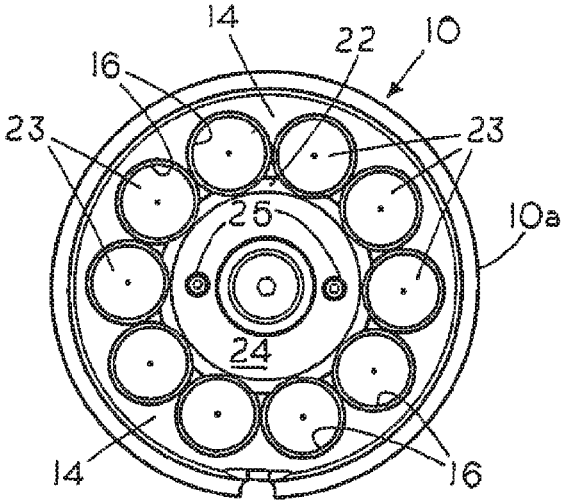
FIG. 12 is a plan view of the invention similar to FIGS. 2-5 but with a pair of fasteners holding a die retainer in place of a single fastener.
Figure 16:
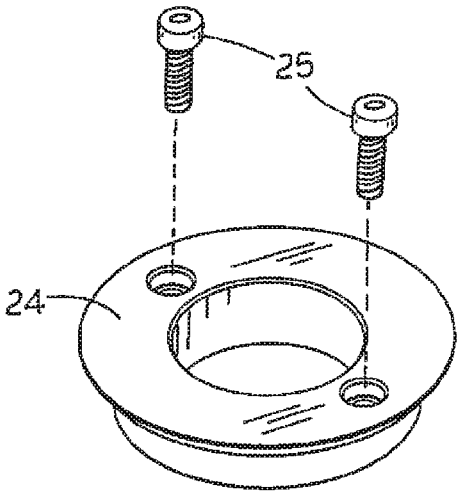
FIG. 16 is a perspective view showing the modified form of push plate of FIG. 12 held in place by means of a pair of screw fasteners instead of a single screw fastener.

Refer now to FIG. 12 which shows a push plate 24 that has a pair of diametrically opposed openings for fasteners, such as cap screws 25 instead of a single centrally located fastener 26. The fasteners 25 are also shown in FIG. 16.

In preparing for operation, as the tightener applies pressure to the pliable ring 22, it expands laterally exerting an outward force that acts to secure all of the dies in place simultaneously while also acting in combination with the shoulder 23*a* to provide additional support for holding the dies securely in their pockets. If the retaining member is formed from metal, the lip 22*a* will hold the dies in place without exerting any outward radial force.

Although recesses 22*b* are preferred, the recesses in the retainer are optional. When no recesses are used, the outer surface of the retaining member 21 can then be cylindrical in shape as shown in FIG. 17 so as to contact the dies 23 along a vertical line in the case of a rigid retainer or a strip 70 in the case of a flexible retainer, in which case as the fastener 26 is tightened, a progressively greater area of the retaining member will be brought into contact with the centrally facing surface of each die 23 thereby allowing a greater retention force to be provided as the circumstances of use require.

Figure 13:
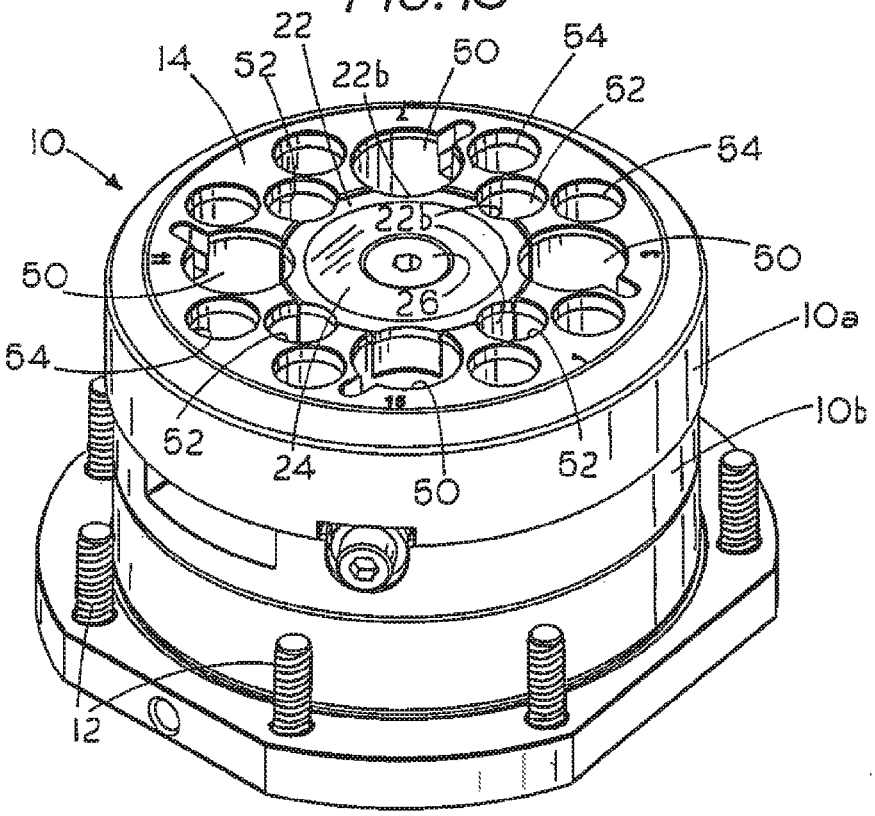
FIG. 13 is a slightly enlarged view similar to FIG. 2 showing pockets of different size dies and including eight outboard die pockets that do not interact with the die retainer.

Refer now to FIG. 13 which shows how the dies can be of different sizes. In this case, the multipunch body member 10*a* is provided with large pockets 50 as well as small pockets 52 for dies (not shown), each held in place by the retainer 22 which has both large recesses 22*b* and small recesses 22*b*. The recesses 22*b* can be of any shape and of various sizes to fit both the large and small diameter dies contiguous with the die retainer 22. In this case the multipunch body member 10*a* is provided with additional pockets 54 near an outside edge which do not interact with the retainer 22. The outer dies can be held in place in any conventional well-known manner as by setscrews (not shown).

Figure 14:
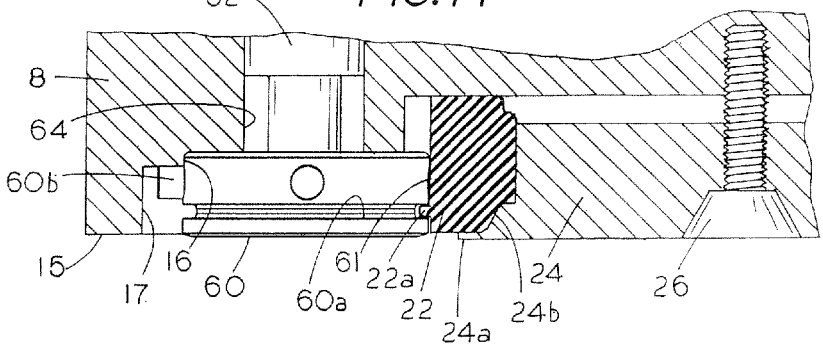
FIG. 14 is a partial vertical sectional view taken on line 14-14 of FIG. 1 to show a stripper held in place on a multipunch body member by a retainer and push plate secured to the body member.
Figure 15:
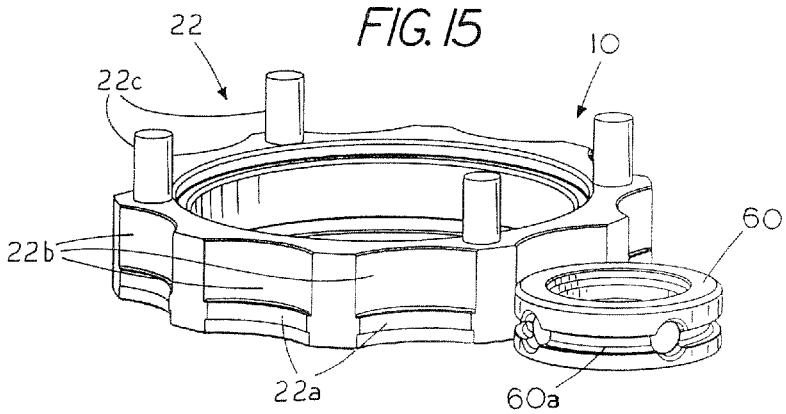
FIG. 15 is a perspective view showing a stripper of FIG. 14 in engagement with the retainer of FIG. 14 as seen from above.

Refer now to FIGS. 14 and 15 which illustrate how the invention is used to hold punch strippers in a multipunch upper body member 8. In this case, the multipunch body member 8 has a lower end surface 15 facing downwardly that includes a circle of pockets 16 (only one of which is shown) arranged concentrically around a central axis in a manner similar to the pockets described above for each holding a stripper 60. Each of the strippers 60 is mounted concentrically over the lower end of one of the punches 62 in the usual way and each punch is mounted within a bore 64 for axial sliding movement in a well-known manner through the center of the stripper 60. The stripper 60 can include a locating pin 60*b* of a suitable known construction which fits within a slot 17 that extends radially outward from the pocket 16. In this case, the inner aspect of each of the strippers 60 projects centrally as shown at 61 where it is in contact with the retaining member 22. The retaining member is provided with a circumferentially extending lip or flange 22*a* which projects into a groove 60*a* that extends circumferentially around the stripper 60. With the lip 22*a* projecting into each groove 60*a*, the strippers are all held securely within the pockets 16. During use, the operator places each of the strippers 60 into one of the circumferentially arranged pockets 16, aligned concentrically with punch 62. The retaining member is positioned with the lip 22*a* extending into each of the grooves 60*a* of all of the strippers 60. The fastener 26 is then tightened, causing the push plate 24 to press upwardly on the retaining member 22 so as to hold the strippers in place as described above in connection with the dies. When the retaining member 22 is formed from a flexible material such as polyurethane plastic, the axial pressure of the push plate will compress the retainer member thereby forcing its peripheral sidewall surface 22*b* within each recess 22*b* firmly into the contact with the adjacent wall portion of the stripper 60 so as to hold it securely in place through frictional engagement in addition to the stabilizing force of the lip 22*a*.

It is important to point out that the invention eliminates the need to completely remove the push plate or retaining member 22. Once the screw fastener 26 is merely loosened and the pressure is relieved, the dies can be slipped out of their pockets thus saving both time and effort as well as allowing the push plate and retainer 22 to remain attached to the body member 10.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. A multipunch body for a multiple punch and die assembly adapted for installation into a punch press comprising:

a multipunch body member that includes a ring of pockets wherein each pocket holds a die or stripper that is removably mounted therein, the multipunch body member also having a central recess within the ring of pockets in the body member and communicating radially therewith, a plurality of punches slidably mounted in the multiple punch and die assembly in alignment with the pockets, a retaining member held in the central recess of the body member, said retaining member has a peripheral surface extending therearound that is constructed and arranged to be expanded radially and thereby hold at least one of the adjacent multiple dies or strippers to thereby clamp the at least one adjacent die or stripper within the pocket therefor as the dies or strippers cooperate with the punches during operation of the punch press.

2. The multiple punch and die assembly of claim 1 wherein the retaining member is held in place by a push plate that is secured to the multipunch body member by a tightener that applies axial pressure which expands the retaining member.

3. The multiple punch and die assembly of claim 1 wherein the retaining member is ring-shaped and wherein the peripheral surface thereof contacts portions of the dies or strippers, said peripheral surface of the retaining member has recesses that are of the same size as each other or of varying sizes for securing the dies or strippers in place on the multipunch body member.

4. The multiple punch and die assembly of claim 1 wherein the retaining member is a ring of flexible material that frictionally engages the dies or strippers to hold them in place.

5. The multiple punch and die assembly of claim 4 wherein the flexible material of the retaining member is deformed so as to expand an outer surface of the retaining member into frictional engagement with the dies or strippers.

6. The multiple punch and die assembly of claim 5 wherein at least one tightener is connected to the retaining member for compressing the retaining member to thereby deform the retaining member so as to expand the peripheral surface of the retaining member to provide the frictional engagement with the dies or strippers.

7. The multiple punch and die assembly of claim 1 wherein the retaining member has a peripheral lip that engages at least a portion of the dies or strippers to thereby hold the dies or strippers in place on the multipunch body member.

8. The multiple punch and die assembly of claim 1 wherein the retaining member is formed from a metal or rigid nonmetallic material and includes a peripheral portion that moves radially a sufficient distance to mechanically engage each of the dies or strippers for holding the dies or strippers in place within the pockets during operation.

9. The multiple punch and die assembly of claim 1 wherein the retaining member is formed from a ring of flexible material, a push plate is mounted in a central recess of the ring of flexible material, at least one tightener is connected to the push plate to apply pressure for compressing the retaining member to thereby cause a peripheral portion of the retaining member to expand into frictional contact with the dies or strippers to enhance retention thereof in place within the pockets, and release of the tightener allows removal of the dies or strippers without removal of the retainer.

10. The multiple punch and die assembly of claim 1 wherein the retaining member includes a peripheral sidewall having a circumferentially distributed series of outwardly opening concave surface segments of the same size or of various different sizes that frictionally engage adjacent sidewalls of the dies or strippers for holding the dies or strippers in place during operation.

11. The multiple punch and die assembly of claim 10 wherein the concave surface segments of the retainer comprise recesses that are spaced apart from one another by circumferentially extending segments of the retainer that are aligned with partitions located between the pockets.

12. The multiple punch and die assembly of claim 1 wherein one of a) the retaining member and b) the dies or strippers has a lip portion that is aligned to engage a groove in the other of a) or b) for retaining the dies or strippers in place within the pockets of the multipunch body member.

13. The multiple punch and die assembly of claim 1 including a push plate in contact with a free end surface of the retaining member and a compression spring between the push plate and the multipunch body member for yieldably urging the push plate away from the retaining member.

14. The multiple punch and die assembly of claim 13 wherein at least one threaded screw fastener is connected between the push plate and the multipunch body member for pressing the retaining member into engagement with at least one die or stripper that is located in one of the pockets.

15. The multiple punch and die assembly of claim 1 wherein the pockets comprise partially cylindrical indentations in the multipunch body member that each have an axial centrally facing opening aligned radially with the central recess in the retaining member, the retaining member is a ring formed from a flexible or rigid material, a push plate is mounted in an opening within the retaining member, and at least one tightener is operatively connected to the push plate to force the push plate against the retaining member to expand the peripheral surface of the retaining member to hold the dies or strippers in the pockets.

16. The multiple punch and die assembly of claim 1 wherein the retaining member comprises a flexible or rigid polymeric material having a circumferentially distributed series of outwardly opening circle segments around the periphery thereof and each of the circle segments corresponds in shape to conform to an aligned die or stripper so as to frictionally engage and retain each of the dies or strippers within the pockets of the multipunch body member.

17. The multiple punch and die assembly of claim 1 wherein the retaining member includes at least one lateral projection aligned with each of the dies or strippers for overlapping at least a portion of at least one die or stripper to retain the at least one die or stripper within one of the pockets of the multipunch body member.

18. The multiple punch and die assembly of claim 1 wherein the retaining member has a cylindrical peripheral sidewall surface to provide contact with the dies or strippers along an axial line or strip between the retaining member and each of the dies or strippers.

19. The multiple punch and die assembly of claim 1 wherein the retaining member includes a roughened surface finish, said roughened surface finish being constructed to thereby enhance frictional engagement with the die or stripper.

20. The multiple punch and die assembly of claim 1 wherein a push plate is forced into engagement with the retaining member by means of at least one tightener attached to the multipunch body member and the push plate has thereon a camming element comprising a tapered surface located between the push plate and the retaining member to expand the retaining member against at least one of the dies or strippers.

* * * * *